US005303004A

United States Patent [19]

Maruyama et al.

[11] Patent Number: 5,303,004

[45] Date of Patent: Apr. 12, 1994

[54] APPARATUS FOR DRIVING IMAGE BEARING MEMBER VIA TORQUE LIMITER

[75] Inventors: Hiroyoshi Maruyama, Yokohama; Kazuo Kagiura, Higashi; Tatsuya Shiratori, Kawasaki; Naomasa Kimura, Yokohama; Eiichi Ando, Toride; Masanari Shirai, Chigasaki; Yoshikuni Toyama, Yokohama; Masashi Ohashi, Tokyo, all of Japan

[73] Assignee: Canon Kabushiki Kaisha, Tokyo, Japan

[21] Appl. No.: 944,751

[22] Filed: Sep. 14, 1992

Related U.S. Application Data

[63] Continuation of Ser. No. 681,647, Apr. 8, 1991, abandoned, which is a continuation of Ser. No. 310,959, Feb. 16, 1989, abandoned.

[30] Foreign Application Priority Data

Feb. 19, 1988 [JP] Japan ..... 63-38320

[51] Int. Cl.[5] ..... G03G 15/00

[52] U.S. Cl. ..... 355/200; 355/211

[58] Field of Search ..... 355/200, 210, 211, 245, 355/296; 464/39

[56] References Cited

U.S. PATENT DOCUMENTS

| | | | |
|---|---|---|---|
| 3,577,747 | 5/1971 | Brown | 464/39 |
| 3,889,491 | 6/1975 | Wanner et al. | 464/39 X |
| 4,530,588 | 7/1985 | Kimura et al. | 355/245 X |
| 4,671,645 | 6/1987 | Saito et al. | 355/211 |

FOREIGN PATENT DOCUMENTS

| | | | |
|---|---|---|---|
| 188627 | 9/1985 | Japan . | |
| 2180795 | 4/1987 | United Kingdom | 355/211 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

A driving mechanism for driving an electrophotographic photosensitive body operates through a torque limiter. The torque limiter is arranged on a support shaft for supporting the photosensitive body. A driving gear for driving a developing member is arranged coaxially with the torque limiter independently of the latter. This arrangement reduces the load applied to the torque limiter. In addition, the mechanism remains compact.

7 Claims, 2 Drawing Sheets

APPARATUS FOR DRIVING IMAGE BEARING MEMBER VIA TORQUE LIMITER

This application is a continuation of prior application Ser. No. 07/681,647 filed Apr. 8, 1991 now abandoned which is a continuation of application Ser. No. 07/310,959 filed Feb. 16, 1989, now abandoned.

BACKGROUND OF THE INVENTION

Field of the Invention

The present invention relates to an image forming apparatus such as a copying machine, printer and the like, in which an image is formed through a predetermined process by forming a latent image on an image bearing member such as a photosensitive drum, visualizing the latent image using a developer in a developing device, transferring the visualized image from the image bearing member onto a transfer member and then fixing the transferred image. More particularly, the present invention relates to an image forming apparatus which can prematurely detect an abnormality in driving apparatuses for driving an image bearing member such as a photosensitive drum and a developing device to effectively prevent damage or destruction of the image forming apparatus and which includes a compact driving apparatus adapted to drive such image bearing member and the like.

Related Background Art

Conventionally, in an image forming apparatus such as a copying machine, printer and the like, in which an image is formed through a predetermined process by forming a latent image on an image bearing member such as a photosensitive drum, visualizing the latent image using a developer in a developing device, transferring the visualized image from the image bearing member onto a transfer member, fixing the transferred image, and cleaning the residual developer on the image bearing member by means of a cleaner, the above-mentioned predetermined processes such as the latent image forming process, image visualizing process, image transferring process and the like necessary to form the image were carried out by rotating the image bearing member such as the photosensitive drum constituted by an endless belt or a rotatable drum.

In this case, as the driving apparatuses for driving or rotating the image forming member such as the photosensitive drum (hereinafter, referring to the driving apparatuses associated with the photosensitive drum), a mechanism comprising a gear fixed to a flange of the photosensitive drum and a gear connected to a driving source so that the photosensitive drum is rotated by the driving source, or a mechanism wherein a photosensitive drum driving plate arranged coaxially with a support shaft for the photosensitive drum is rotated in such a manner that a pin fixed to the driving plate engages with and entrains a flange of the photosensitive drum to rotate the latter have been used. Further, the developing device used in the image visualizing process was driven through the gear fixed to the flange of the photosensitive drum or by means of a discrete driving mechanism for driving the developing device.

Some of these driving apparatuses have a torque limiter for limiting an upper limit of a driving torque to prevent the damage of the image forming apparatus when an abnormality occurred in load torques regarding the photosensitive drum, developing device, cleaner and the like. In some cases, such a driving apparatus was used in a container for receiving waste or exhaust toner to prevent the damage of a toner discharging member provided in the container, which would be caused during the rotation of the toner discharging member when the container was filled with the toner. However, in the conventional driving apparatus of the type that the developing device and the toner discharging member are simultaneously driven by drivingly rotating the gear provided on the flange of the photosensitive drum, when the torque limiter for detecting the abnormality in the load torque is arranged upstream of the driving system for the photosensitive drum, the torque limiter cannot detect the abnormality in the load torques unless the capacity of the torque limiter is set to be larger than all of the load torques in the downstream side of the photosensitive drum, thus increasing an error regarding the operating torque of the limiter.

More particularly, for example, if it is assumed that the operating torque of the photosensitive drum is $4\pm0.5$ kg.cm, the operating torque of the toner discharging member in the container is $2\pm0.2$ kg.cm, the operating torque of the developing device is $8\pm1$ kg.cm and the tolerance of the torque limiter itself is $\pm10\%$, the set value of the operating torque of the torque limiter will be larger as in the order of $17.5\pm1.8$ kg.cm for the total operating torque of $14\pm1.7$ kg.cm for the total operating torque of $14\pm1.7$ kg.cm, with the result that the torque limiter cannot detect the abnormality unless the torque of 7.0 kg.cm ($=(17.5+1.8)-(14-1.7)$), at the most, is generated in the abnormality condition.

In the torque limiter, if the abnormality in the load torques is detected by using, such larger operating torque, for example, when the abnormality occurs in a cleaner having the toner discharging member, there will be a greater possibility of causing serious damage to the cleaner, with the result that, in the worst case, the cleaner must be replaced. Of course, it is possible that the cleaner unit and the like are previously constructed more strongly for providing against such abnormality; however, such countermeasure is not desirable from the viewpoint of the available space in the, image forming apparatus, the cost of the constructional parts and the like.

Further, in the conventional driving apparatus in which an additional or discrete torque limiter is provided regarding the toner discharging member for treating the waste toner removed in the cleaning operation and stored in the container in the cleaner to detect premature abnormality in the cleaner, the abnormality in the cleaner can be positively detected. However, in this case, since the abnormality in the cleaner is signaled to an operator only by an abnormal noise, if the operator continues a copying operation without being aware of the abnormality, the toner will overflow out of the cleaner to smear the interior of the image forming apparatus.

In addition, in the conventional driving apparatus in which the developing device is driven by a discrete driving mechanism, the above-mentioned drawback can be eliminated by arranging the torque limiter upstream of the driving system for the photosensitive drum. However, in this case, since the discrete driving mechanism is added, there arises a problem that the number of the constructural parts of the image forming apparatus is increased and that the apparatus cannot be easily reduced in size.

SUMMARY OF THE INVENTION

It is an object of the present invention is to provide an image forming apparatus including a driving apparatus wherein a torque value of a torque limiter can be set to detect, with high sensitivity, an abnormality in even lower load torque of an image bearing member such as a photosensitive drum when the image bearing member is driven by the driving apparatus having the torque limiter.

It is another object of the present invention is to provide an image forming apparatus including a driving apparatus which can drive a plurality of elements such as a developing device, a waste toner discharging member and the like, as well as an image bearing member such as a photosensitive drum by a compact driving means including a torque limiter to form an image, and wherein a torque value of the torque limiter can be set to positively detect an abnormality in even lower load torque.

The above objects can be achieved by the present invention. In brief, according to the present invention, there is provided a driving apparatus adapted to be used with an image forming apparatus which can form an image on an image bearing member through predetermined image forming processes, and capable of drivingly rotating the image bearing member by means of a driving means including a torque limiter arranged coaxially with a shaft for supporting the image bearing member.

According to a preferred embodiment of the present invention, the driving apparatus includes a driving means for directly transmitting a driving force from a driving source in order to directly drive a developing device used in the predetermined image forming processes.

Accordingly, in the present invention, by directly driving the image bearing member such as the photosensitive drum by means of the driving means including the torque limiter arranged coaxially with the support shaft for supporting the image bearing member, and by arranging, in parallel with said driving means, the discrete driving means for directly transmitting the driving force from the driving source in order to drive the developing device, it is possible to positively perform the operation of the torque limiter and to set the value of the torque limiter in high response to the photosensitive drum and to provide a compact construction. Further, by stopping the rotation of the photosensitive drum as the image bearing member when the torque limiter is operated, it is possible to positively signal the abnormality to the operator.

DETAILED DESCRIPTION OF THE PREFERRED EMBODIMENTS

The present invention will now be explained in connection with preferred embodiments thereof with reference to the accompanying drawings.

Figure 1:
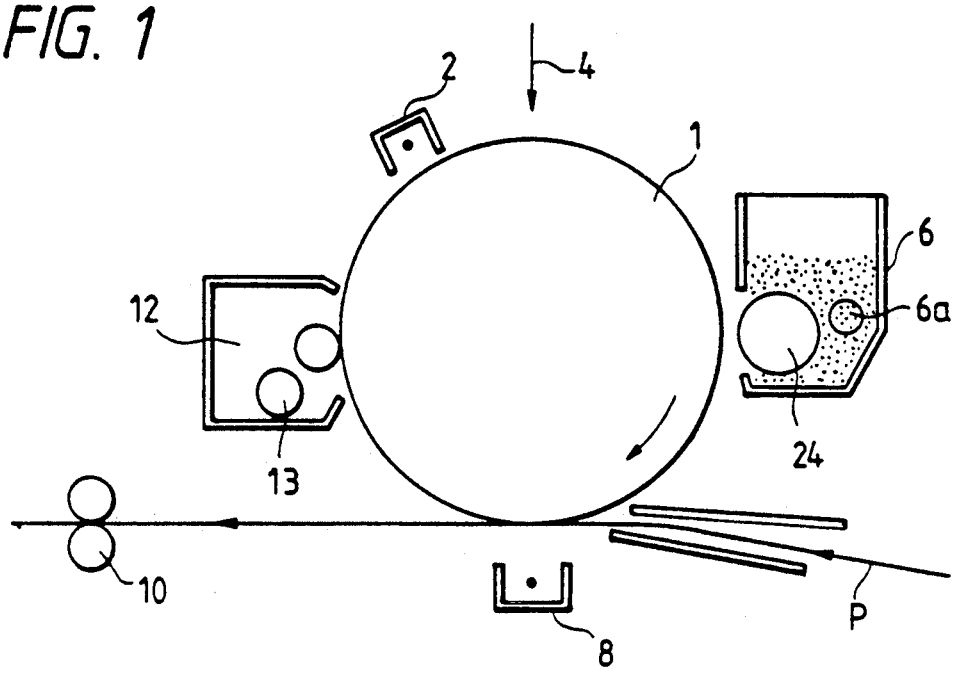
FIG. 1 is a schematic sectional side view of an image forming apparatus according to a preferred embodiment of the present invention.

FIG. 1 shows a preferred embodiment of an image forming apparatus according to the present invention.

The image forming apparatus shown in FIG. 1 comprises an electrophotographic photosensitive drum 1 as an image bearing member, which is formed in a cylindrical shape and is rotated in a direction shown by an arrow in FIG. 1. Around the photosensitive drum, along the direction of rotation thereof, there are, in order, a charging device 2 for uniformly charging a peripheral surface of the photosensitive drum 1; an information light beam 4 emitted from an exposure device (not shown) for performing an exposing operation in response to an image information, for example, by means of a laser optical system to form a latent image on the photosensitive drum 1; a known developing device 6 for visualizing the latent image by applying a toner as a developer to the latent image formed on the photosensitive drum 1; a transfer charging device 8 for transferring the visualized image from the photosensitive drum 1 onto a transfer sheet P such as a paper; a known fixing device 10 for fixing the image transferred to the transfer sheet P; and a cleaning device 12 for cleaning the residual toner on the photosensitive drum 1. The cleaning device 12 includes a toner discharging member 13 for conveying the removed residual toner toward one end of the cleaning device 12, which member comprises, for example, a screw member.

Image forming processes carried out by the image forming apparatus having the construction mentioned above are well known in the art; and, thus, the detailed explanation regarding the image forming processes will be omitted here.

Figure 2:
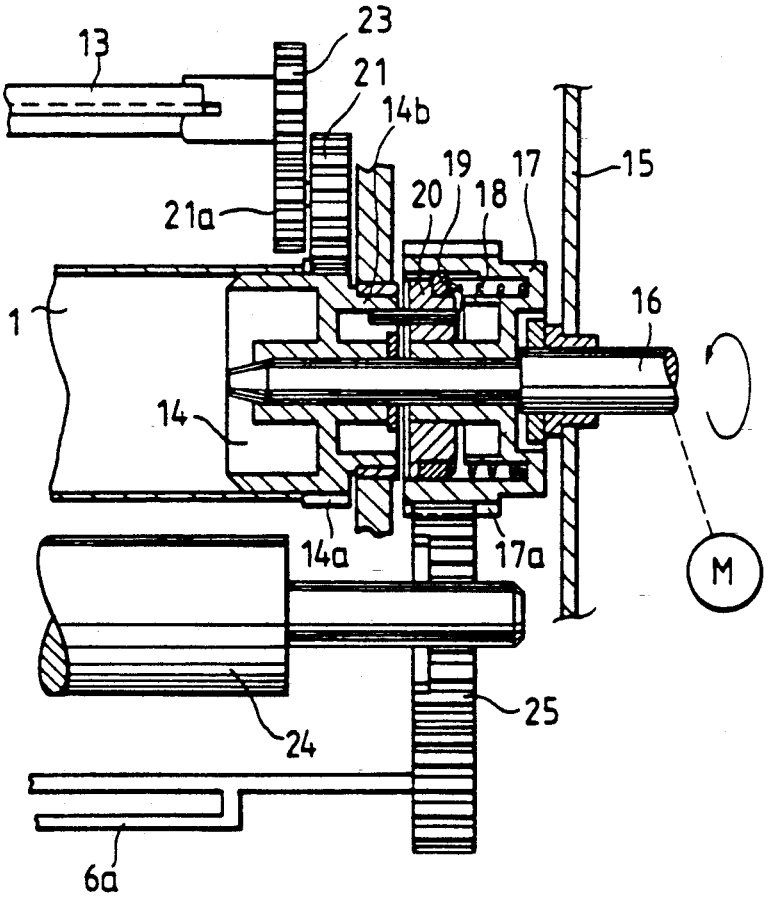
FIG. 2 is a longitudinal sectional view showing the details of a photosensitive drum of FIG. 1.

Now, referring to FIG. 2 showing the details of a part of the photosensitive drum 1, the photosensitive drum 1 has a flange 14 fixed thereto, on an outer peripheral surface of which a gear **14*a* for transmitting a driving force to the toner discharging member 13 is formed. The flange 14 is rotatably supported, at its central portion, by a support shaft 16 rotatably mounted on a frame 15 of the image forming apparatus. Accordingly, the photosensitive drum 1 is freely rotatably supported by the frame 15 through the support shaft 16**.

Further, a substantially cylindrical gear 17 acting as a driving means is fixed to the support shaft 16 coaxially therewith. As shown, a coil spring 18, a ring-shaped limiter plate 19 and a substantially circular driving plate 20 having a step (see FIG. 3) are incorporated in the gear 17 in a predetermined position, which elements 18–20 constitute a torque limiter 17A as a whole. A pin **20*a* protruded from the driving plate 20 of the torque limiter 17A toward the flange 14 can engage by one of ribs 14*b* (FIG. 4) formed in the flange 14. The gear 14*a* formed on the peripheral surface of the flange 14 meshes with an idler gear 21 having a small gear 21*a* fixed thereto, which meshes with a driving gear 23 for driving the toner discharging member 13**.

In addition, a gear portion **17*a* formed on an outer peripheral surface of the gear 17 meshes with a sleeve gear 25 fixed to a developing sleeve 24**.

Now, the concrete construction of the torque limiter 17A will be further explained.

Figure 3:
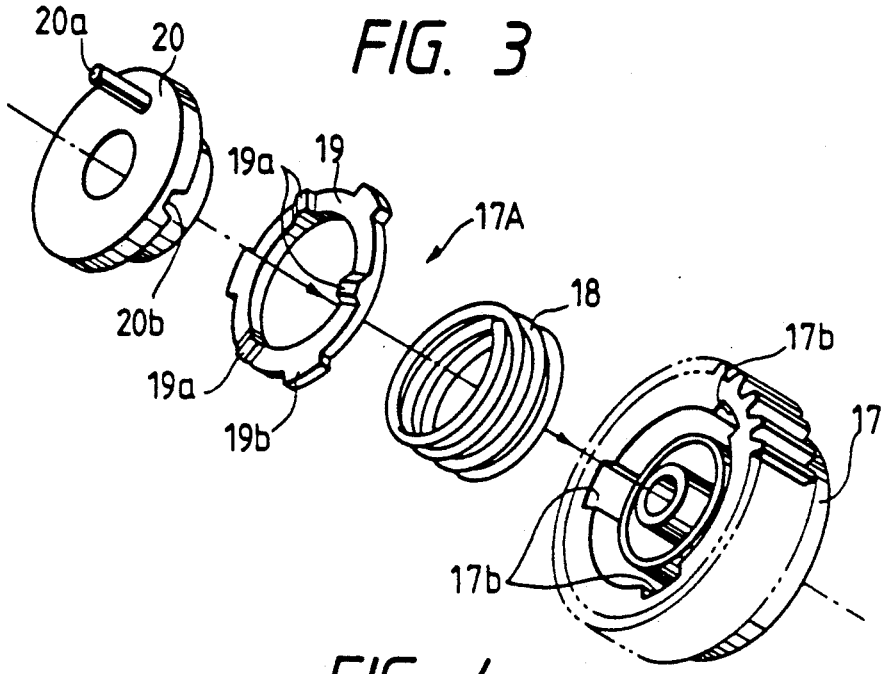
FIG. 3 is an exploded perspective view of a torque limiter incorporated into a gear as a driving means used with the photosensitive drum of FIG. 2.
Figure 4:
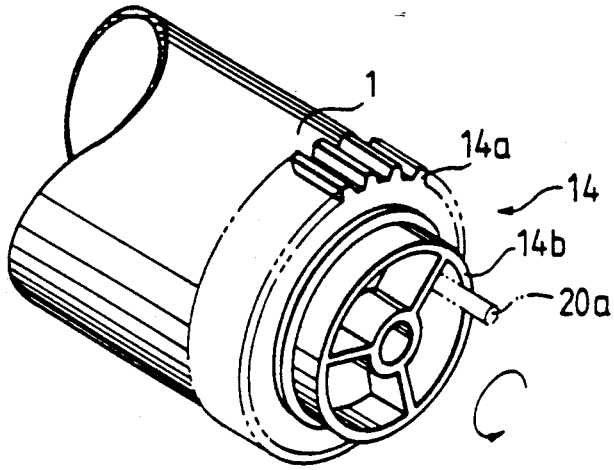
FIG. 4 is a perspective view of a flange portion of the photosensitive drum of FIG. 1.

As shown in FIG. 3, three grooves 17b are formed in an inner peripheral surface of the substantially cylindrical gear 17 acting as the driving means in predetermined positions, and these 17b are engaged by corresponding pawls 19b formed on an outer periphery of the limiter plate 19 in predetermined positions; thus, when assembled, the limiter plate 19 can be slidably moved along a central axis of the gear 17 while engaging by the grooves 17b. Further, three trapezoidal projections 19a are formed on an outer side surface of the limiter plate 19 in predetermined positions, which projections are engaged by corresponding trapezoidal recesses 20b formed in an inner side surface of the driving plate 20. The driving plate 20 has an outer diameter that the driving plate is fitted in the gear 17.

With this construction, in the assembled condition (FIG. 2) that the driving plate 20, limiter plate 19 and coil spring 18 are positioned in place in the gear 17, when the gear 17 is drivingly rotated, the limiter plate 19 tends to rotate against the load applied to the pin 20a of the driving plate 20. In this case, since the rotational force from the limiter plate 19 is transmitted to the driving plate 20 through the engagement between the projections 19a of the limiter plate 19 and the recesses 20b of the driving plate 20, an escaping force tending to move the limiter plate 19 along the inclined surfaces of the trapezoidal recesses 20b of the driving plate is created. In this case, as long as the escaping force is smaller than a resultant force comprised of a friction force between the coil spring 18 and the limiter plate 19 and of a friction force between the trapezoidal projections 19a and the recesses 20b, the limiter plate 19 cannot escape from the recesses 20b and thus transmits the rotational force to the driving plate 20. However, when the load applied to the pin 20a of the driving plate 20 becomes larger, the escaping force will also become larger accordingly. Consequently, if the escaping force exceeds the resultant force comprised of a friction force between the coil spring 18 and the limiter plate 19 and of a friction force between the trapezoidal projections 19a and the recesses 20b, the limiter plate 19 will escape from the trapezoidal recesses 20b to slide inwardly along the grooves 17b of the gear 17. Thus, the rotational force is not transmitted to the driving plate 20. This is the operating condition of the torque limiter 17A. Of course, it should be noted that a torque value for creating the operation condition of the torque limiter 17A can be properly set by appropriately selecting an angle of the inclined surface of the projection (and recess), coefficient of friction between the projection and recess, and the force of the coil spring 18.

With the construction mentioned above, when the support shaft 16 is rotated by the driving source 14, the gear 17 as the driving means is also rotated together with the shaft 16, thus driving the developing sleeve 24 in the developing device 6 and an agitating mechanism 6a (FIG. 1) in the developing device 6 through the sleeve gear 25.

Further, upon the rotation of the gear 17, as shown in FIGS. 2 and 3, the driving force is transmitted to the coil spring 18, limiter plate 19, driving plate 20 and pin 20a in order, with the result that the pin 20a drivingly rotates the flange 14 and the photosensitive drum 1 through the engagement between the pin 20a and the rib 14b (FIG. 4) of the flange 14. In addition, since the gear 14a formed on the outer periphery of the flange 14 meshes with the idler gear 21, the driving gear 23 for driving the toner discharging member 13 for conveying the residual toner removed by the cleaner to the predetermined collection position is also rotated through the idler gear 21 and its small gear 21a. Accordingly, in this case, the load torques from the photosensitive drum 1 and the toner discharging member 13 are applied to the pin 20a of the torque limiter 17A.

In this way, according to the illustrated embodiment of the present invention, since the photosensitive drum 1 and the toner discharging member 13 are directly driven through the medium of the gear 17 acting as the driving means having the torque limiter of the above-mentioned construction, it is possible to set the torque value for initiating the operation of the torque limiter in high response to the abnormality in even the smaller load in the driving portions.

Further, as mentioned above, in the illustrated embodiment, it is possible to drive the developing device 6 through the medium of the gear portion 17a formed on the outer periphery of the gear 17 acting as the driving means having the torque limiter 17A, thus reducing the installation space of the driving mechanism and accordingly reducing the whole dimension of the image forming apparatus.

Now, as a numerical example, when the image forming apparatus according to the above-mentioned embodiment is used, if the load torque of the photosensitive drum 1 and the toner discharging member 13 is $4\pm0.5$ kg.cm, and the load torque of the developing device 6 is $4\pm1.5$ kg.cm, the load torques created when the toner container is filled with the toner can be detected by the torque limiter having the set torque value of $5\pm0.5$ kg.cm. In this case, it is possible to detect the abnormality with a maximum error of 2 kg.cm=((5.5−3.5 )kg.cm).

On the other hand, in the above-mentioned conventional image forming apparatus, the torque value of the torque limiter used must be set to $11\pm1.1$ kg.cm. In this case, the maximum error will be 6.1 kg.cm (=12.1−6)kg.cm, and therefore, the abnormality cannot be detected unless the load torque is increased by about 6 kg.cm due to the abnormality.

In addition, with the above-mentioned construction of the illustrated embodiment, since the photosensitive drum 1 is stopped immediately after the torque limiter is operated, when the torque limiter is operated (i.e., when the abnormality occurs), the image will be intermittently formed on the copying sheet, which clearly signals the abnormality to the operator.

It should be noted that the present invention is not limited to the illustrated embodiment wherein the torque limiter is assembled in the substantially cylindrical gear. For example, as an alternative, the torque limiter may be assembled in the flange 14 of the photosensitive drum 1.

Further, it is apparent that, in the present invention, the torque limier does not depend upon the type thereof, but depends upon only the installation position thereof.

Figure 5:
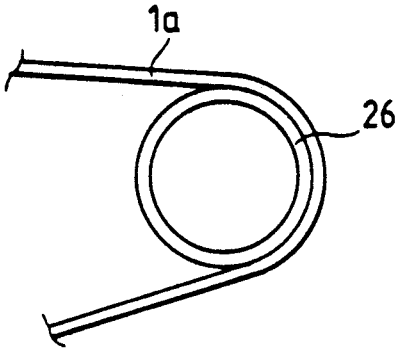
FIG. 5 is a partial side view of a photosensitive belt according to another embodiment of an image bearing member.

Furthermore, the effect obtainable from the present invention does not depend upon the configuration of the photosensitive drum (image bearing member). For example, as shown in FIG. 5, even when an electrophotographic photosensitive belt 1a entrained around a flange 26 (in place of the flange 14 of the drum) on which the torque limiter acts is used, a satisfactory effect can be obtained.

As mentioned above, according to the present invention, since the photosensitive drum as the image bearing member is driven by the gear acting as the driving means having the torque limiter arranged coaxially with the support shaft for the photosensitive drum and the driving gear for directly transmitting the driving force from the driving source in order to drive the developing device is associated with the first-mentioned gear, it is possible to set the torque value of the torque limiter in higher response to the photosensitive drum than in the conventional case, whereby the abnormality in the load torque of the photosensitive drum can be prematurely detected and can be signaled to the operator positively. Further, since the photosensitive drum and the developing device can be driven by the single driving mechanism, the size of the image forming apparatus can be considerably reduced.

What is claimed is:

1. An image forming apparatus for recording an image onto a recording medium, comprising:

an image bearing member;

developing means, having a developer bearing member, for developing a latent image formed on said image bearing member;

transfer means for transferring the image formed by said developing means onto the recording medium;

a developer container having a developer conveying means for conveying developer removed from said image bearing member in a predetermined direction after the transfer operation by said transfer means;

a driving source;

a first drive force transmitting means for transmitting a driving force from said driving source;

a second drive force transmitting means for transmitting the drive force from said first drive force transmitting means to said image bearing member via a torque limiter;

a third drive force transmitting means, connecting said image bearing member and said developer conveying means, for transmitting the drive force from said image bearing member to said developer conveying means; and a fourth drive force transmitting means for transmitting the drive force from said first drive force transmitting means to said developing means independently of said torque limiter, wherein transmission of the drive force to said image bearing member is interrupted when said torque limiter operates thereby indicating that the developer in the cleaning means has reached a predetermined amount.

2. An image forming apparatus according to claim 1, wherein said image bearing member comprises a photosensitive drum.

3. An image forming apparatus according to claim 1, wherein said torque limiter interrupts transmission of the drive force to said image bearing member when said developer conveying means is overloaded.

4. An image forming apparatus according to claim 1, wherein said image bearing member and said developer conveying means are connected by an idler gear meshing with a gear provided on a peripheral surface of said image bearing member and a driven gear which receives the drive force from said idler gear.

5. An image forming apparatus according to claim 1, wherein said torque limiter is provided along a peripheral surface of a rotary shaft of said image bearing member.

6. An image forming apparatus according to claim 1, wherein said developer conveying means comprises a screw for conveying the developer removed from a photosensitive drum to a containing position, and the drive force from said driving source is transmitted through said torque limiter and image bearing member to said screw.

7. An image forming apparatus according to claim 1, wherein said developer member comprises a developing sleeve.

* * * * *